United States Patent [19]

Kramer

[11] 4,386,485

[45] Jun. 7, 1983

[54] MULTICOMPONENT EXTENDIBLE STRUCTURE

[75] Inventor: Richard E. Kramer, Damascus, Md.

[73] Assignee: Fairchild Industries, Inc., Germantown, Md.

[21] Appl. No.: 240,420

[22] Filed: Mar. 4, 1981

[51] Int. Cl.[3] ..... E04H 12/34

[52] U.S. Cl. ..... 52/108; 52/632

[58] Field of Search ..... 52/108, 632; 182/41

[56] References Cited

U.S. PATENT DOCUMENTS

| | | | |
|---|---|---|---|
| 2,130,993 | 9/1938 | Dubilier | 52/108 |
| 2,661,082 | 12/1953 | Ziegler | 52/108 |
| 2,799,368 | 7/1957 | Alter | 52/108 |
| 2,844,232 | 7/1958 | Le Roy | 52/108 |
| 3,213,573 | 10/1965 | Bohr et al. | 52/108 |
| 3,319,987 | 5/1967 | Bohr et al. | 52/108 |
| 3,503,164 | 3/1970 | Berry et al. | 52/108 |

FOREIGN PATENT DOCUMENTS

| | | | |
|---|---|---|---|
| 1508937 | 1/1967 | France | 52/108 |

*Primary Examiner*—James L. Ridgill, Jr.

*Attorney, Agent, or Firm*—Michael W. York

[57] ABSTRACT

A multicomponent extendible structure which includes three elongated sheets of material which each have two long edge portions and connecting means located on the long edge portions for connecting adjacently located long edge portions together when the adjacently located edge portions are in a substantially nonbent condition and for permitting the long edge portions to be separated when the long edge portions are in a bent condition. The connecting means includes a series of alternating projections and slots located on each long edge portion and the projections on the long edge portion of one elongated sheet of material are adapted to be received by the slots on an adjacently located edge portion of another elongated sheet of material. The long edge portions are readily separable to permit the elongated sheets of material to be separated and stored when the multicomponent extendible structure is in its stored or non-extended condition. Spaced reinforcing members are also provided which are located with their long axis generally perpendicular to the long axis of the elongated sheets of material to give the sheets of material additional strength.

10 Claims, 7 Drawing Figures

MULTICOMPONENT EXTENDIBLE STRUCTURE

BACKGROUND OF THE INVENTION

Multicomponent extendible structures are by no means new, and they have found many useful applications. Such structures have been utilized both on the ground and in space to provide rigid or semirigid extended structures which can be utilized as antennas or as booms for extending or retracting various types of equipment.

One of the primary advantages of a multicomponent extendible structure is that it comprises two or more elongated thin sheets of material which are capable of being rolled or otherwise compacted into a small compact package. As a consequence a multicomponent extendible structure need take up very little space when it is in its stored or packaged configuration and yet it is capable of being extended to form an elongated structure of considerable length. This ability to transform itself from a small compact stored configuration into a comparatively large operational configuration makes such multicomponent extendible structures particularly attractive for use in space where it is necessary to have a compact configuration for transferring the structure into space in view of the limited capacity or volume associated with space vehicles. Of course, the same is true for other applications such as military antennas and the like where it is desirable to stow an antenna in a small package when it is not in use.

One of the problems associated with such multicomponent extendible structures has been how to obtain a rigid structure when the multicomponent extendible structure is in its extended configuration. In this connection it is desirable that the extended multicomponent extendible structure have some type of cross section that lends rigidity to the extended structure. Such a cross section might take the form of a triangle, rectangle or the like. In order to obtain such a cross section it is necessary to interconnect the edge portions of the elongated sheets of material which form the multicomponent extendible structure. It is also important that the edges of these elongated sheets be securely fastened so that they cannot be pulled apart. Otherwise the multicomponent extendible structure would lose its rigidity and strength.

In the past various techniques have been tried for fastening the edges of two or more elongated sheets of material together. An example of one type of method of attachment is set forth in U.S. Pat. No. 3,503,164 which discloses a tubular extendible structure that is formed from two elongated sheets of material that have tabs and slots on the edges for joining the elongated sheets of material together. It should be noted however that the tubular extendible structure set forth in this patent is designed to have the tabs remain in the slots during the time that the tubular extendible structure is rolled into its stored compact configuration as well as when it is in its extended position. This may be somewhat satisfactory when there are only two elongated sheets of material involved and it is only desired to have a simple ring shaped or circular shaped cross section. However, for more complex structures which involve more than two elongated sheets, it is generally necessary to separate the sheets for storage purposes such as illustrated in U.S. Pat. No. 3,319,987 where the elongated sheets or strips are separated or rolled on a plurality of rollers. As illustrated in this patent the plurality of elongated sheets of material are fastened together by tongues and slots located along the respective edges of material. It should be noted however that these tongues and slots do not provide in themselves an edge locking system that prevents the edges of the adjacently located elongated sheets from being pulled apart when the multicomponent extendible structure is in its extended configuration.

Consequently, a need exists for a multicomponent extendible structure in which a plurality of elongated sheets of material have their edge portions securely fastened together when the multicomponent extendible structure is in its extended or operational configuration. The current invention provides such a multicomponent extendible structure that permits a plurality of elongated sheets of material to be separately and compactly stored but joined by securely joining together at their edges when the multicomponent extendible structure is extended into its operational configuration.

SUMMARY OF THE INVENTION

This invention relates to extendible structures and more particularly to multicomponent extendible structures.

Accordingly, it is an object of the present invention to provide a multicomponent extendible structure which is capable of being formed from two or more elongated sheets of material.

It is another object of the present invention to provide a multicomponent extendible structure which forms a rigid structure when it is in its extended configuration.

It is an object of the present invention to provide a multicomponent extendible structure that is readily storable in a compact configuration.

It is an object of the present invention to provide a multicomponent extendible structure which has provisions for storing a plurality of elongated sheets separately in a compact configuration.

It is also an object of the present invention to provide a multicomponent extendible structure including a plurality of elongated sheets which are securely connected together when the extendible structure is in its extended configuration.

It is also an object of the present invention to provide a multicomponent extendible structure which is capable of being repeatedly moved from its stored compact configuration to its extended configuration and back to its stored configuration.

It is also an object of the present invention to provide a multicomponent extendible structure which has great strength when it is in its extended configuration.

It is also an object of the present invention to provide a multicomponent extendible structure in which the edges of elongated sheets of material are locked together when the extendible structure is in its extended configuration.

It is also an object of the present invention to provide a multicomponent extendible structure that includes a plurality of elongated sheets which are reinforced to give the extendible structure rigidity when it is in its extended configuration.

The foregoing and other objects are obtained by the present invention by providing a multicomponent extendible structure that includes a plurality of elongated sheets of material which each have two long edges and connecting means located along at least one of the long edge portions of the elongated sheets for connecting adjacently located long edge portions together when the adjacently located edge portions are in a substantially nonbent condition and for permitting the edge portions to be separated when the edge portions are in a bent condition.

BRIEF DESCRIPTION OF THE DRAWINGS

In order that the invention will be more clearly set forth and better understood, reference is made to the accompanying drawings in which.

DETAILED DESCRIPTION OF THE PREFERRED EMBODIMENT

Figure 1:
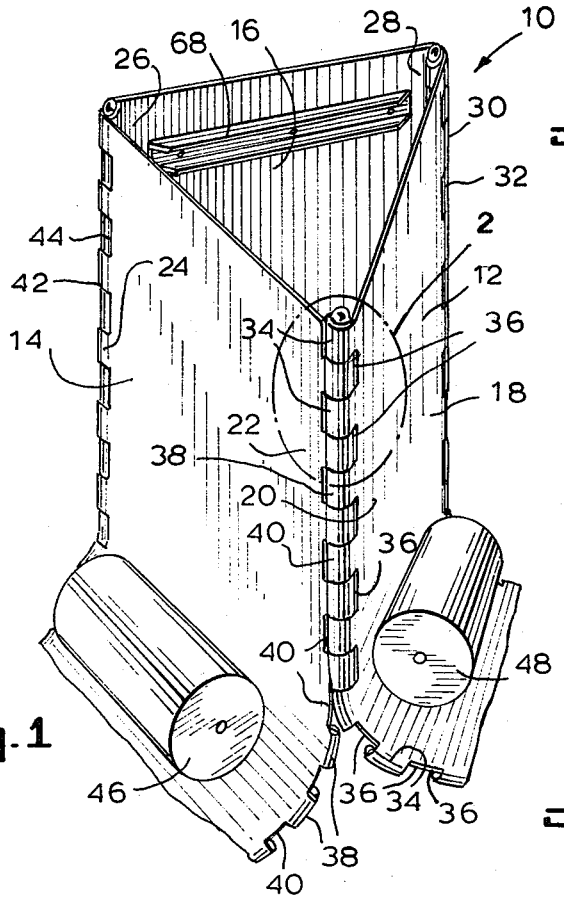
FIG. 1 is a prospective view of the multicomponent extendible structure of the invention illustrating how it is formed into its extended configuration.

Referring first to FIG. 1 the multicomponent extendible structure of the invention is illustrated and is designated generally by the number 10. The multicomponent extendible structure 10 comprises three substantially identical elongated sheets of material designated by the numbers 12, 14 and 16. These elongated sheets of material 12, 14 and 16 each have two long edge portions designated respectively by the numbers 18, 20, 22, 24, 26 and 28. Connecting means comprising means for interlocking the respective long edge portions 18, 20, 24, 26 and 28 are located on these elongated edge portions and comprise a series of alternating projections and slots such as their respective projections and slots 30 and 32 on the edge portion 18, the projections and slots 34 and 36 on the edge portion 20, the projections and slots 38 and 40 located on the edge portion 22 and the projections and slots 42 and 44 located on the edge portion 24.

As illustrated in FIG. 1, the multicomponent extendible structure 10 forms a structure having a generally triangular shaped cross section when it is in its erected or extended configuration in view of the fact that the elongated sheets of material 12, 14 and 16 have their respective end portions 18, 20, 24, 26 and 28 connected to the adjacently located edge portions of the other elongated sheets of material. It will also be noted that the unerected portions of the sheets of material 12, 14 and 16 which extend outward from beneath the rollers 46 and 48 do not have their edge portions interconnected since the projections and slots such as the projections 34 for the edge portion 20 of the elongated sheet 12 do not fit into the slots 40 on the adjacently located edge portion 22 of the elongated sheet 14. It should also be noted that the rollers 46 and 48 guide the respective sheets of the elongated material 12 and 14 into position so that the multicomponent extendible structure 10 is capable of being erected. It will, of course, be appreciated that there is another roller for the elongated sheet 16 for performing the same function. However, this roller is not visible in FIG. 1. These same rollers 46 and 48 also assist in pulling the respective edge portions 18, 20, 22, 24, 26 and 28 apart when the multicomponent extendible structure 10 is moved into its stored position.

Figure 2:
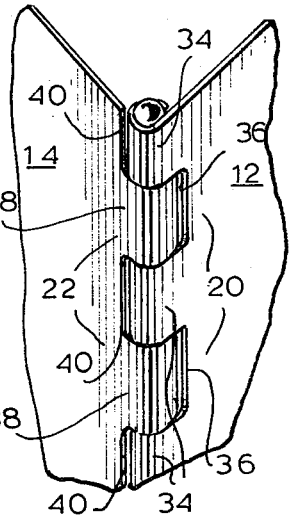
FIG. 2 is an enlarged portion of the structure illustrated in FIG. 1 taken within the circle 2 thereof.

An enlarged view of a corner portion of the structure illustrated in FIG. 1 is presented in FIG. 2 and illustrates with greater clarity the manner in which the edge portion 20 of the elongated sheet 12 is interconnected with the edge portion 22 of elongated sheet 14. As illustrated in FIG. 2 the projections and slots are sized and shaped to permit the projections located on the edge portion of one of the sheets 12 and 14 to be received by the slots located on the edge portion of another sheet and consequently the projections 34 fit into the respective adjacently located slots 40 located in the edge portion 22 of the elongated sheet 14. In addition the projections 38 located on the edge portion 22 of the elongated sheet 14 also fit into the adjacently located slots 36 located on the edge portion 20 of the elongated sheet 12.

Figure 3:
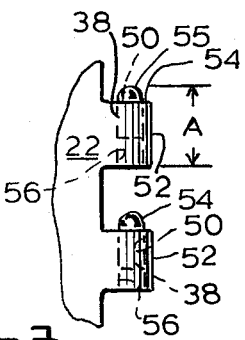
FIG. 3 is a side elevational view of the portion of the structure illustrated in FIG. 2.
Figure 4:
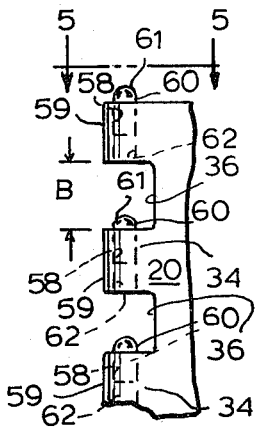
FIG. 4 is a side elevational view of a portion of the structure illustrated in FIG. 2.

Further details of the manner in which the edge portions 20 and 22 of the elongated sheets 12 and 14 are interconnected are presented in FIGS. 3 through 7. FIGS. 3 and 4 illustrate the corresponding edge portions 20 and 22 that were set forth in FIG. 2 but in their separated condition. As illustrated in FIG. 3 the projections 38 each have a hollow aperture 50 extending through it in a direction substantially parallel to the outer edge surface 52 of the projection 38. Located within the upper portion of this aperture 50 is engaging means comprising a substantially cylindrical engaging member 54 that projects from the projection 38. The lower portion 56 of the aperture 50 however remains open and unobstructed. FIG. 4 illustrates the corresponding construction of the edge portion 20, and it will be noted that the respective projections 34 each have an aperture 58 which is similar to the aperture 50 which was previously described in connection with the edge portion 22 set forth in FIG. 3. This aperture 58 is substantially parallel to the outer edge or surface 59 of the projections 34. In addition, engaging means comprising a cylindrical shaped engaging member 60 that projects from the projection 34 is located in the upper portion of the aperture 58. However, the lower portion 62 of the aperture 58 is open or unobstructed. As illustrated, the engaging means comprising the engaging member 54 projects from the projection 38 into the adjacently located slot on the edge portion 22 of the same sheet that has the projection 38 and in a similar manner the engaging means comprising the engaging member 60 also projects from the projection 34 into the adjacently located slot 36 on the edge portion 20 of the same sheet that has the projection 34. It will be noted that the distance A from the outer upper end of the engaging member 54 to the lower surface of the projection 38 of the edge portion 22 is larger than the distance B which is the width of the slot 36 on the edge portion 20. Consequently, the projection 38 with its engaging member 50 cannot be slid laterally into the slot 36.

Figure 5:
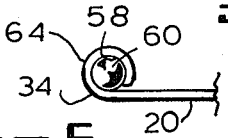
FIG. 5 is an end view of the structure illustrated in FIG. 4 taken in the direction of the line 5—5 thereof.

FIG. 5 illustrates the end view of the edge portion 20 and the projection 34. It will be noted that the outer end portion 64 of the projection 34 has been curled inwardly to form the substantially circular aperture 58. The upper porion of the aperture 58 is formed in such a manner so as to crimp a portion of the engaging member 60 to securely hold it within the projection 34. Since as illustrated in FIGS. 3 and 4, there is an obvious interference in view of the distance A being greater than the distance B which prevents the elongated edge portions 20 and 22 from being interconnected by moving them laterally, it is necessary to interconnect these edge portions 20 and 22 in the manner illustrated in FIG. 1. As indicated in FIG. 1 as the respective elongated sheets 12 and 14 come together they are bent outwardly by the respective rollers 48 and 46. As a consequence when the projection 38 of the edge portion 22 comes into close proximity to the slot 36 in the edge portion 20, the end 55 of the engaging member 54 begins to move or be inserted into the corresponding open portion 62 of the aperture 58 of the projection 34. Then after the projecting end portion 55 of the engaging member 54 has substantially fully entered been inserted into the lower portion 62 of the aperture 58, the projection 38 is then moved fully into the slot 36. Of course, at the same time the outer end 61 of the projection 34 on the edge portion 20 is moving or being inserted into the lower open portion 56 of the aperture 50 in the projection 38. As a consequence, the aperture 36 is able to accommodate the projection 38 and the outer portion 55 of the engaging member 54. Whereas this would not have been possible without bending the elongated sheets of material 12 and 14, consequently, the edge portions 18, 20, 22, 24, 26 and 28 of the respective elongated sheets 12, 14 and 16 are able to be interconnected when the edge portions are in a substantially nonbent condition and yet be capable of being permitted to be separated when the edge portions are in a bent condition.

Figure 6:
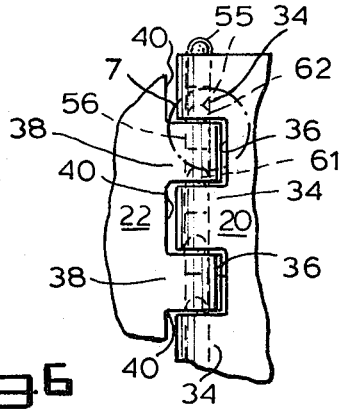
FIG. 6 is a view of the structure illustrated in FIGS. 3 and 4 when the structure are locked together.

Details of the interconnected edge portions 20 and 22 are illustrated in greater detail in FIG. 6. As illustrated in FIG. 6 the projections 38 of the edge portion 22 are fully in position in the corresponding slots 36 of the edge portion 20 and in a similar manner the projections 34 of the edge portion 20 are fully in position in the corresponding adjacent respective slots 40 in the edge portion 22. When this occurs it will be noted that the outer end portion 55 of the engaging member 54 is located within the aperture 62 in the projection 34 and also that the outer end portion 61 of the engaging member 60 is located in the position within the aperture 56 in the projection 38. Consequently, it is impossible to separate the edge portion 20 from the interconnected edge portion 22 in view of the fact that the projections 55 and 61 extend into the respective apertures 62 and 56 and hence prevent movement of the projections 38 and 34 from the respective slots 36 and 40. The only way to separate the projections 34 and 38 from the respective slots 40 and 36 is by bending the edge portions 20 and 22 along with the entire elongated sheets 12 and 14 in the manner illustrated through the use of the rollers 46 and 48 in FIG. 1.

Figure 7:
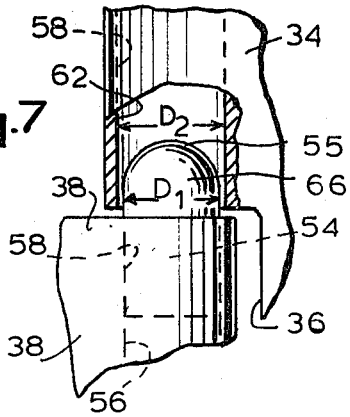
FIG. 7 is an enlarged view of a portion of the structure illustrated in FIG. 6 taken within the circle 7 thereof.

The details of a portion of the structure set forth in FIG. 6 are illustrated in greater detail in FIG. 7. As illustrated in FIG. 7 the outer portion 55 of the generally cylindrical shaped engaging member 54 is located in place within the lower open aperture 62 of the projection 34. As previously indicated a portion of the engaging member 54 is crimped into place within the aperture 58 of the projection 38. It will be noted that the outer portion 55 of the engaging member 54 has a substantially rounded configuration. However, it should also be noted that there is an adjacently located cylindrical section 66 comprising means for preventing separation of the projection 38 located on the edge of one sheet from the slot 36 located on the edge of another sheet which has at least a portion thereof that projects into the aperture 62. It will also be noted that the diameter $D_1$ of this cylindrical portion is less than the diameter $D_2$ of the aperture 62 in the projection 34. This is necessary to insure that the outer end portion 55 of the interconnecting member 54 can be fully seated within the aperture 62 when the edge portions 20 and 22 are fully locked or connected together. The cylindrical portion 66 is also important since the side walls which contact the walls of the aperture 62 prevent separation of the projection 38 from the slot 36 since this cylindrical portion 66 gives a much stronger resistance when it contacts the walls of the aperture 62 then would a curved or slanted surface.

As illustrated in FIG. 1 it may be desirable to add a series of reinforcing members 68. These reinforcing members would be attached to the interior surface of the elongated members 12, 14 and 16 so that when the multicomponent extendible structure 10 is in its erected configuration these reinforcing members 68 are located on the inside of the elongated sheets 12, 14 and 16. These reinforcing members 68 would be bonded or riveted at spaced intervals to the surface of the elongated sheets 12, 14 and 16 with the elongated axis of the reinforcing member 68 being substantially parallel to the end portion of the elongated sheets 12, 14 and 16. The purpose of these reinforcing members 68 is to give added rigidity to the multicomponent extendible structure 10 when it is in its extended configuration and yet not unduly interfere with the collapsing or erection of the multicomponent extendible structure 10.

The multicomponent extendible structure 10 is utilized in the following manner. Suitable guide members or the like which are known in the art such as the guide rollers 46 and 48 are suitably placed in order to appropriately bend the elongated sheets 12, 14 and 16 and to bring their edge portions 20 and 22, 24 and 26, and 28 and 18 together as illustrated in FIG. 1. Either a pulling or pushing force is then exerted upon the elongated sheets of material to cause them to be passed under the rollers 46 and 48 so that the respective projections and slots such as the projections 38 and the slots 36 come together with an angular relationship that permits the outer portions 55 of the interconnecting members 54 to be inserted into the apertures 62 in the projections 34 and to permit the outer projections 61 of the engaging members 60 to be inserted into the apertures 56 in the projections 38. As the edge portions 20 and 22 of the respective sheets 12 and 14 then move upwardly into the nonbent configuration they become fully intermeshed or locked together in view of the previous discussion related to FIGS. 6 and 7. This process is then continued by moving successive projections 34 and 38 into the respective slots 40 and 36 until a sufficient length of the elongated sheets 12, 14 and 16 have been connected together and extended outward or upward. When it is desired to retract the multicomponent extendible structure 10 then the foregoing process is merely reversed in that an appropriate force such as a downward force is exerted upon the elongated sheets 12, 14 and 16 which results in the edge portions 20 and 22 of the sheets 12 and 14, the edge portions 24 and 26 of the sheets 14 and 16, and the edge portions 28 and 18 of the sheets 16 and 12 being bent by rollers such as the rollers 48 and 46 illustrated in FIG. 1 to cause the various projections such as the projections 34 to be withdrawn from the respective slots such as the slots 40 to disengage the edge portions such as the edge portions 20 and 22 of the sheets 12 and 14.

It will be appreciated by those skilled in the art that the elongated sheets 12, 14 and 16 may be made from a variety of suitable materials such as beryllium copper or the like. In addition, when the elongated sheets 12, 14 and 16 have their respective edge portions separated they may be stored in a roll on a roller (not shown) or stored in some similar manner known in the art.

Although the invention has been described in considerable detail with reference to a certain preferred embodiment, it will be understood that variations or modifications may be made within the spirit and scope of the invention as defined in the appended claims.

What is claimed is:

1. A multicomponent extendible structure comprising a plurality of elongated sheets of material each having two long edge portions and means for interlocking the long edge portions of said elongated sheets located along at least one of each of the long edge portions of said elongated sheets for connecting adjacently located long edge portions together when the adjacently located edge portions are in a substantially non-bent condition and for permitting the edge portions to be separated when the edge portions are in a bent condition, said interlocking means comprising a series of alternating projections and slots located on the edge portions of said elongated sheets, said projections and slots being sized and shaped to permit the projections located on the edge portion of one of said sheets to be receiving by the slots located on the edge portion of another sheet, each of said projections have an aperture and engaging means projecting from said projection insertable into the aperture of a corresponding projection located on the edge portion of an adjacently located elongated sheet when at least a portion of the edge portion of said adjacently located elongated sheet is bent.

2. The multicomponent extendible structure of claim 1 wherein said engaging means projects from a projection into an adjacently located slot in the edge portion of the same elongated sheet that has said projection.

3. The multicomponent extendible structure of claim 2 wherein the projection has an outer edge surface and wherein the aperture in said projection extends in a direction substantially parallel to the outer edge surface of said projection.

4. The multicomponent extendible structure of claim 3 wherein said projection and said engaging means are sized to prevent said projection and its engaging means from being slid literally into a slot located on the edge portion of another sheet which prevents the elongated edge portions of said elongated sheets from being interconnected by moving them laterally.

5. The multicomponent extendible structure of claim 4 wherein said engaging means comprises an engaging member and said engaging member has means for preventing separation of the projection located on the edge of one sheet from the slot located on the edge of an adjacently located sheet.

6. The multicomponent extendible structure of claim 5 wherein said separation preventing means includes side walls for contacting the walls of an aperture in a projection.

7. The multicomponent extendible structure of claim 6 further comprising reinforcing means for reinforcing said elongated sheets.

8. The multicomponent extendible structure of claim 6 wherein the aperature in said projection is formed by at least a portion of the projection being curled.

9. The multicomponent extendible structure of claim 8 wherein said engaging member has at least a portion thereof that is substantially cylindrical.

10. The multicomponent extendible structure of claim 9 wherein said engaging member is a separate member secured to said projection.

* * * * *